US008828915B2

(12) United States Patent
Kuilder et al.

(10) Patent No.: US 8,828,915 B2
(45) Date of Patent: Sep. 9, 2014

(54) THIXOTROPIC CORROSION PROTECTION ADDITIVES FOR PRESERVATIVE LIQUIDS AND LUBRICATING GREASES

(75) Inventors: Markus Kuilder, Oftersheim (DE); Steffen Sandhöfner, Neulußheim (DE)

(73) Assignee: Rhein Chemie Rheinau GmbH, Mannheim (DE)

( * ) Notice: Subject to any disclaimer, the term of this patent is extended or adjusted under 35 U.S.C. 154(b) by 0 days.

(21) Appl. No.: 13/030,523

(22) Filed: Feb. 18, 2011

(65) Prior Publication Data

US 2011/0294710 A1 Dec. 1, 2011

(30) Foreign Application Priority Data

Feb. 23, 2010 (EP) ..... 10154383

(51) Int. Cl.

| | |
|---|---|
| ***C10M 159/24*** | (2006.01) |
| ***C09K 3/00*** | (2006.01) |
| ***C23F 11/00*** | (2006.01) |
| ***C10M 141/08*** | (2006.01) |

(52) U.S. Cl.

CPC ..... *C10M 141/08* (2013.01); *C10M 2207/126* (2013.01); *C10M 2223/043* (2013.01); *C10N 2230/02* (2013.01); *C10M 2219/044* (2013.01); *C10N 2230/12* (2013.01); *C10N 2240/40* (2013.01)

USPC ..... 508/459; 252/395

(58) Field of Classification Search

USPC ..... 508/459; 252/395

See application file for complete search history.

(56) References Cited

U.S. PATENT DOCUMENTS

| | | | | |
|---|---|---|---|---|
| 3,981,682 | A | 9/1976 | Ward et al. | |
| 5,108,641 | A | 4/1992 | Ahmed et al. | |
| 5,726,130 | A * | 3/1998 | Yamanaka | 508/152 |
| 6,919,302 | B2 | 7/2005 | Legros et al. | |
| 7,718,592 | B2 * | 5/2010 | Zimmermann et al. | 510/224 |
| 2004/0029749 | A1 * | 2/2004 | Legros et al. | 508/487 |
| 2005/0079982 | A1 | 4/2005 | Bence | |

OTHER PUBLICATIONS

European Search Report from co-pending Application EP10154383 dated Jul. 1, 2010, 6 pages.

* cited by examiner

*Primary Examiner* — Vishal Vasisth

(74) *Attorney, Agent, or Firm* — Nicanor A. Kohncke

(57) ABSTRACT

The invention relates to novel thixotropic corrosion protection additives, to carrier substances comprising these corrosion protection additives, to processes for their preparation and to their use for preservative liquids and lubricating greases.

9 Claims, 2 Drawing Sheets

THIXOTROPIC CORROSION PROTECTION ADDITIVES FOR PRESERVATIVE LIQUIDS AND LUBRICATING GREASES

CROSS REFERENCE TO RELATED PATENT APPLICATION

The present patent application claims the right of priority under 35 U.S.C. §119 (a)-(d) and 35 U.S.C. §365 of European Patent Application No. 10154383 filed on Feb. 23, 2010.

The invention relates to novel thixotropic corrosion protection additives, to carrier substances comprising these corrosion protection additives, to processes for their preparation and to their use for preservation liquids and lubricating greases.

Corrosion protection additives are used in lubricants and form a protective film as a result of a chemical reaction and/or addition of polar compounds onto the metal surface.

The thixotropic properties promote easier application and adhesion and thus the corrosion protection properties on the metal surface.

The corrosion protection additives known are in particular sulphonates, in particular dialkylbenzenesulphonate, and/or carboxylates or ash-free corrosion protection additives, such as partial esters of succinic acid, amine-neutralized succinic acid derivatives or else amine-neutralized phosphoric acid partial esters.

To improve the corrosion protection, film formers are often used, such as e.g. oxidized petrolatum or lanolin fatty acid. It is known that the effectiveness of the corrosion protection increases with the thickness of the film-forming layer, as a result of which film formers, such as e.g. oxidized petrolatum and lanolin fatty acid are preferred. These often have the disadvantage that the corrosion protection additives resulting therefrom have a reduced ability to be washed off and have worse solubility in the end product.

Alternatively to this, U.S. Pat. No. 3,981,682 describes corrosion protection additives based on longer-chain unsaturated dicarboxylic acids in conjunction with fatty acids, such as oleic acid or coconut fatty acid. However, coconut fatty acid disadvantageously forms a smaller film thickness.

There was therefore a great need for corrosion protection additives which do not have the disadvantages of the prior art.

Surprisingly, it has now been found that the thixotropic corrosion protection additives according to the invention of coconut fatty acid as film former in combination with dialkylbenzenesulphonic acid do not have the disadvantages of the prior art in terms of the ability to be washed off and especially in terms of the solubility with the carrier substances, but exhibit good corrosion inhibiting properties.

The present invention therefore provides novel thixotropic corrosion protection additives, which are a mixture of at least one dialkylbenzenesulphonate with coconut fatty acid.

Figure 1:
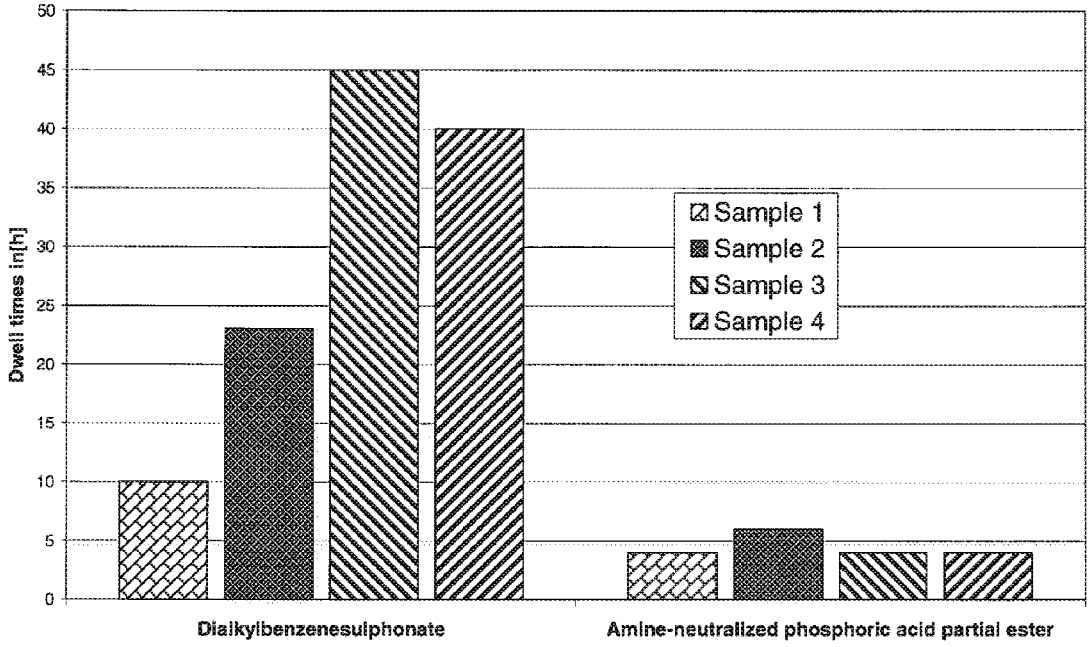
FIG. 1 provides the results of the dwell time measurements for various samples.

Within the context of the invention, alkyl is the $C_8$-$C_{24}$-alkyl, preferably $C_{10}$-$C_{14}$-alkyl, where the two alkyl radicals within the molecule may be identical or different. Furthermore, preference is given to the use of mixtures of different dialkylbenzenesulphonates.

The two alkyl radicals can occupy any position relative to the sulphonate group within the molecule, i.e. ortho, meta and/or para position. As a rule, mixtures are used.

The dialkylbenzenesulphonates can be prepared by sulphonation of the corresponding dialkylbenzenes and subsequent neutralization with suitable bases, such as e.g. calcium hydroxide by the methods familiar to the person skilled in the art. However, these are also standard commercial products which are obtainable e.g. from Rhein Chemie Rheinau GmbH under the trade name Additin® RC 4220.

Coconut fatty acid is a commercially available product which is available e.g. from Nordische Ölwerke.

Since it is a natural product, the composition can fluctuate depending on the country of origin and manufacturer, although this has no effects on the film-forming properties envisaged in the course of the invention. Accordingly, all types of coconut fatty acid can be used.

The coconut fatty acid is preferably a virtually exclusively saturated coconut oil which is rich in lauric acid and myristic acid.

A typical composition is, without the invention being limited thereto, ca. 48% lauric acid=$C_{12}$-saturated fatty acid
ca. 18% myristic acid=$C_{14}$-saturated fatty acid
ca. 9% palmitic acid=$C_{16}$-saturated fatty acid
ca. 7% caprylic acid=$C_8$-saturated fatty acid
ca. 7% oleic acid=$C_{18}$-unsaturated fatty acid
ca. 6% capric acid=$C_{10}$-saturated fatty acid
ca. 3% stearic acid=$C_{18}$-saturated fatty acid
ca. 2% linoleic acid (<1% other oleic acids).

In the thixotropic corrosion protection additives according to the invention, the quantitative ratio of dialkylbenzenesulphonate to coconut fatty acid can be chosen arbitrarily. However, preference is given to ratios of dialkylbenzenesulphonate to coconut fatty acid of from 5:1 to 1:5. Ratios of from 3:1 to 1:3 can also be used and are likewise preferred. In one particularly preferred embodiment of the invention, quantitative ratios of from 3:2 to 2:3 are established.

In a further embodiment of the invention, the thixotropic corrosion protection additives can comprise further additives depending on the field of application, such as demulsifiers, stabilizers, antioxidants, antifoams, wear protection and/or high-pressure additives, but also further known corrosion protection additives, e.g. sulphonates, carboxylates, naphthenates etc.

Moreover, the present invention provides a process for the preparation of thixotropic corrosion protection additives, according to which either dialkylbenzenesulphonic acid is reacted with at least one base and then coconut fatty acid is added, or alternatively dialkylbenzenesulphonic acid is reacted with a base in the presence of coconut fatty acid.

Within the context of the invention, bases are alkali metal hydroxides and/or alkaline earth metal hydroxides, preferably barium hydroxide or calcium hydroxide.

The base is preferably added in excess, although it is also possible to use the base in stoichiometric ratios.

The reaction/neutralization preferably takes place at temperatures of from 60 to 99° C. in the presence of small amounts of water.

The coconut fatty acid should be stirred in at temperatures above the melting point of the coconut fatty acid, i.e. preferably above 40° C., very particularly preferably at temperatures around 60° C.

After the reaction is complete and before drawing off the product, a filtration step is also preferred in order to separate off any excess base which may be present.

It is likewise possible to react the dialkylbenzenesulphonic acid with at least one base in the presence of some of the intended coconut fatty acid and to the remaining amount of coconut fatty acid once neutralization has taken place.

The invention further provides carrier substances comprising at least one thixotropic corrosion protection additive according to the invention.

Within the context of the invention, carrier substances are preferably oils, solvents or fats.

Oils which can be used here are long-chain, and also branched oils of any viscosity, such as e.g. solvent neutral, polyalpha-olefins, hydrocracked oils.

Suitable solvents are all known compounds, the subsequent field of application being decisive for the selection. The term solvent encompasses here e.g. hydrocarbon-containing solvents, such as e.g. pentane or all types of white spirits, and also polar solvents, such as ethyl acetate. These are standard commercial compounds. By way of example, mention may be made e.g. of special-boiling-point spirit 45/60 or 80/110 or Isopar® compounds, obtainable from Exxon Mobil Oil. Thus, for example in fire hazard areas, compounds with boiling temperatures significantly above 50° C. are preferred, such as e.g. special-boiling point spirit 80/110 or Isopar®H.

Fats which can be used are any reaction products of the aforementioned oils with thickeners. Thickeners which may be mentioned by way of example are lithium, sodium or calcium soaps or else also polymer thickeners. The mixing ratio of oil to thickener can be chosen freely and is governed by the intended use.

The thixotropic corrosion protection additive is introduced into the carrier substances preferably at temperatures above 40° C.

The invention moreover provides the use of the thixotropic corrosion protection additives according to the invention in preservative liquids or lubricating greases.

The preservative liquids serve in particular to temporarily protect metallic workpieces, e.g. on the transport route prior to manufacturing, for storage etc.

Also included by this is the method for the anticorrosive furnishing of preservative liquids in which the mixture according to the invention of at least one dialkylbenzenesulphonate with coconut fatty acid, of the aforementioned definitions, is used.

The examples below serve to illustrate the invention without limiting it.

WORKING EXAMPLES

The following samples were prepared:

60 g of the corrosion protection-effective component dialkylbenzenesulphonate for the mixtures A or phosphoric acid partial ester for the mixtures B and also an amine-neutralized succinic acid derivative for mixture C were introduced as initial charge in a 250 ml beaker, and 40 g of the liquefied film former lanolin fatty acid or coconut fatty acid, or tallow fatty acid, in the amounts listed in the tables below, were added thereto. The respective mixtures were then homogenized for 30 min at 80° C. by means of stir bar and magnetic hotplate.

| Mixture A | Sample 1 (CE) | Sample 2 (CE) | Sample 3 | Sample 4 (CE) |
|---|---|---|---|---|
| Dialkylbenzenesulphonate = a neutral calciumsulphonate | 100% | 60% | 60% | 60% |
| with C12 alkyl radicals, obtainable from Rhein Chemie Rheinau GmbH | | | | |
| Lanolin fatty acid | | 40% | | |
| Coconut fatty acid | | | 40% | |
| Tallow fatty acid | | | | 40% |
| Appearance | Clear | Solid | Slightly cloudy | Slightly cloudy |

| Mixture B | Sample 1 (CE) | Sample 2 (CE) | Sample 3 (CE) | Sample 4 (CE) |
|---|---|---|---|---|
| Additin ® RC 4820, an amine-neutralized phosphoric acid partial ester based on aliphatic alcohols | 100% | 60% | 60% | 60% |
| Lanolin fatty acid | | 40% | | |
| Coconut fatty acid | | | 40% | |
| Tallow fatty acid | | | | 40% |
| Appearance | Clear | Clear | Clear | Clear |

| Mixture C | Sample 1 (CE) | Sample 2 (CE) | Sample 3 (CE) | Sample 4 (CE) |
|---|---|---|---|---|
| Amine-neutralized succinic acid derivative | 100% | 60% | 60% | 60% |
| Lanolin fatty acid | | 40% | | |
| Coconut fatty acid | | | 40% | |
| Tallow fatty acid | | | | 40% |
| Appearance | Clear | Clear | Clear | Clear |

CE = Comparative Example

All of the samples of mixtures A, B and C had a comparable film thickness and ability to be washed off. The film thickness was ascertained here as the average film thickness from the gravimetric determination of the untreated metal sheet compared to the coated metal sheet after a drying time of 2 hours following immersion in a 10% solution of the aforementioned samples in the isoparaffinic oil Isopar® H from Exxon Mobil Oil.

The ability to be washed off was determined after storage for 1 minute in 18 liters of a test cleaner solution consisting of tap water with an overall hardness of 10 to 20° German hardness, and 80 g of test cleaner TP 10339* per liter of test cleaner solution. For all of the samples of mixtures A and B, the film was completely removed.

*According to VDA 230-201: Gardo TP 10339 from Chemetall GmbH

There were clear advantages of the thixotropic corrosion protection additive according to the invention (mixture A, sample 3) in the salt spray chamber test, which was carried out as a so-called salt spray fog test in accordance with DIN ISO 9227:

Salt spray fog tests in the sense of the standard DIN ISO 9227 are tests with a continuously sprayed aqueous sodium chloride solution with a mass concentration of 5 g/100 ml as attacking agent. The spraying was carried out with the help of compressed air.

For this test, a 5% NaCl was prepared and the pH was adjusted to 6.5 to 7.2. The temperature 35±2° C. and the salt spray fog were then checked. Four 100 ml measuring cylinders were placed in the chamber. A funnel with a collecting area of 80 $cm^2$ was placed into the cylinders. The salt spray fog was captured over 16 h and was on average 1.5±0.5 ml per hour. The procedure was then as follows:

Steel sheets ST 1405 in accordance with DIN 1623 Part 1 were placed in the chamber at a temperature of 35° C. The angle of inclination of the sheets in the chamber was ca. 25° from the vertical position.

The steel sheets were precleaned with special-boiling-point spirit (60/80) and then wiped with a spirit-saturated cloth until the cloth no longer showed any dark discolourations. The metal sheets labelled with numbers were then hung on a hook and immersed into the sample to be tested 3×30 s. The metal sheets were then stored by hanging in the cabinet for 2 h. The metal sheets were then transferred to the test holder and to the heated salt spray chamber. The assessment was carried out at the pregiven times. Only the front side of the sheet was assessed. The start of rust formation often takes place at the edge of the sheet.

Figure 2:
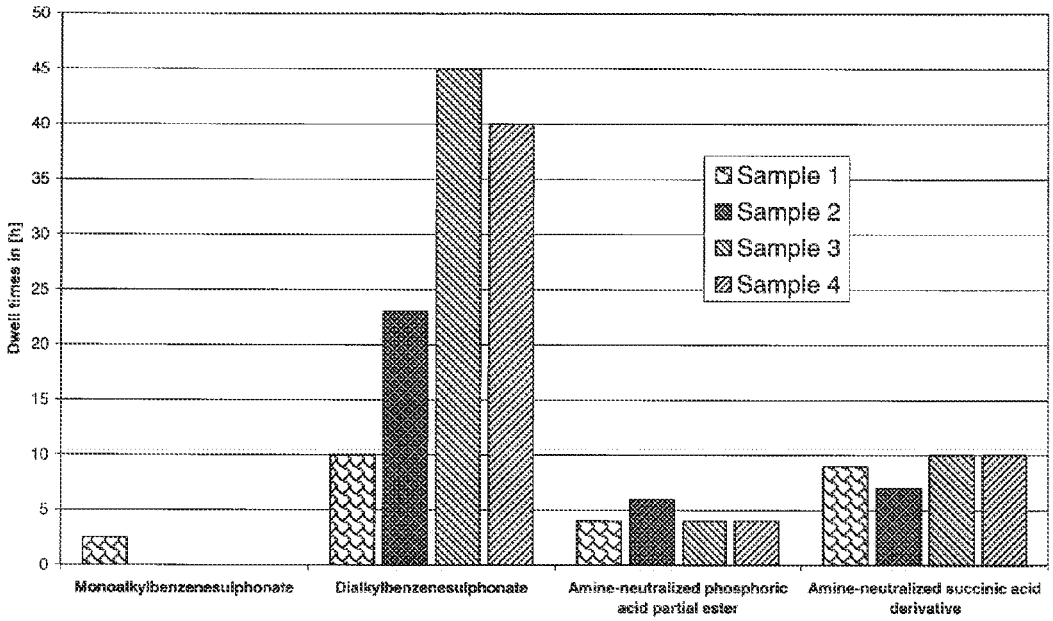
FIG. 2 provides the results of the dwell time measurement for various samples.

The results of the dwell time measurement are depicted in FIG. 1 for dialkylbenzenesulphonate and amine-neutralized phosphoric acid partial ester, and in FIG. 2 are the mixtures A, B and C with all 3 fatty acids compared to 100% strength monoalkylbenzenesulphonate. The dwell times are shown here at which, for an area of <1 $mm^2$, no more than 3 smaller rust points are present.

The inventive thixotropic corrosion protection additive of dialkylbenzenesulphonate and coconut fatty acid (mixture A, sample 3) achieved the best results in the salt spray chamber dwell times and exhibits a clear leap in performance compared with other film formers. This additive likewise exhibits good results in the wash-off test, like corrosion protection additives without film former and, moreover, these readily soluble in all of the tested base oils, such as paraffin-based mineral oils of very different viscosities, white spirits, naphthenic base oils and even in short-chain isoparaffins.

Solubility in isoparaffins in particular is normally a problem since this carrier material is very highly nonpolar and counteracts the dissolution therein of partially polar additives.

What is claimed is:

1. Thixotropic corrosion protection additives, comprising: a mixture of at least one dialkylbenzenesulphonate and a coconut fatty acid, wherein the quantitative ratio of the dialkylbenzenesulphonate to the coconut fatty acid is 5:1 to 1:5.

2. Thixotropic corrosion protection additives according to claim 1, wherein the dialkylbenzenesulphonate is a compound or a mixture of compounds where alkyl is a $C_8$-$C_{24}$-alkyl.

3. Thixotropic corrosion protection additives according to claim 1, wherein the dialkylbenzenesulphonate comprises a mixture of dialkylbenzenesulphonates.

4. A process for the preparation of the thixotropic corrosion protection additives according to claim 1, comprising: reacting the at least one dialkylbenzenesulphonic acid with at least one base and then adding thereto the coconut fatty acid.

5. Carrier substances comprising the thixotropic corrosion protection additive according to claim 1.

6. Carrier substances according to claim 5, wherein said carrier substances are oils, solvents or fats.

7. Process for preserving liquids of lubrication greases, comprising:

adding the thixotropic corrosion protection additives according to claim 1 to said preserving liquids of lubrication greases.

8. A process for the preparation of the thixotropic corrosion protection additives according to claim 1, comprising:

neutralizing the dialkylbenzenesulphonic acid with a base in the presence of the coconut fatty acid.

9. Thixotropic corrosion protection additives, comprising: a mixture of at least one dialkylbenzenesulphonate and a coconut fatty acid, wherein the quantitative ratio of the dialkylbenzenesulphonate to the coconut fatty acid is 3:1 to 1:3.

* * * * *